US009598664B2

(12) United States Patent
Yang et al.

(10) Patent No.: US 9,598,664 B2
(45) Date of Patent: Mar. 21, 2017

(54) COMPOSITION FOR CLEANING A HEAT TRANSFER SYSTEM HAVING AN ALUMINUM COMPONENT

(71) Applicant: Prestone Products Corporation, Lake Forest, IL (US)

(72) Inventors: Bo Yang, Ridgefield, CT (US); Peter M. Woyciesjes, Woodbury, CT (US)

(73) Assignee: Prestone Products Corporation, Lake Forest, IL (US)

( * ) Notice: Subject to any disclaimer, the term of this patent is extended or adjusted under 35 U.S.C. 154(b) by 0 days.

(21) Appl. No.: 14/613,996

(22) Filed: Feb. 4, 2015

(65) Prior Publication Data

US 2015/0152365 A1 Jun. 4, 2015

Related U.S. Application Data

(63) Continuation of application No. 13/404,577, filed on Feb. 24, 2012, now Pat. No. 8,980,815.

(60) Provisional application No. 61/446,799, filed on Feb. 25, 2011.

(51) Int. Cl.

| | |
|---|---|
| ***C11D 3/43*** | (2006.01) |
| ***C11D 11/00*** | (2006.01) |
| ***C11D 7/26*** | (2006.01) |
| ***C11D 7/32*** | (2006.01) |
| ***B08B 9/027*** | (2006.01) |
| ***C11D 1/66*** | (2006.01) |
| ***C11D 3/00*** | (2006.01) |
| ***C11D 3/06*** | (2006.01) |
| ***C11D 3/20*** | (2006.01) |
| ***C11D 3/28*** | (2006.01) |
| ***C11D 3/37*** | (2006.01) |
| *C11D 3/04* | (2006.01) |

(52) U.S. Cl.

CPC ..... *C11D 11/0041* (2013.01); *B08B 9/027* (2013.01); *C11D 1/66* (2013.01); *C11D 3/0026* (2013.01); *C11D 3/0073* (2013.01); *C11D 3/044* (2013.01); *C11D 3/048* (2013.01); *C11D 3/06* (2013.01); *C11D 3/2075* (2013.01); *C11D 3/28* (2013.01); *C11D 3/3757* (2013.01); *C11D 7/261* (2013.01); *C11D 7/265* (2013.01); *C11D 7/3281* (2013.01); *C11D 3/042* (2013.01); *C11D 11/0029* (2013.01)

(58) Field of Classification Search

CPC ..... C09K 5/10; C23F 11/08

See application file for complete search history.

(56) References Cited

U.S. PATENT DOCUMENTS

| | | | | |
|---|---|---|---|---|
| 2,802,788 A | | 8/1957 | Flaxman | |
| 3,419,501 A | | 12/1968 | Levy | |
| 3,492,238 A | | 1/1970 | Wohlberg | |
| 3,959,166 A | | 5/1976 | Oberhofer et al. | |
| 4,329,243 A | * | 5/1982 | Diebel | C09K 5/20 252/75 |
| 4,363,741 A | | 12/1982 | Gould | |
| 4,540,443 A | | 9/1985 | Barber | |
| 4,711,735 A | * | 12/1987 | Gulley | C02F 5/125 252/180 |
| 5,062,987 A | | 11/1991 | Turcotte et al. | |
| 5,071,582 A | | 12/1991 | Conville et al. | |
| 5,338,477 A | | 8/1994 | Chen et al. | |
| 5,342,537 A | | 8/1994 | Conville et al. | |
| 5,468,303 A | | 11/1995 | Thomas, Sr. | |
| 5,606,105 A | | 2/1997 | Davis et al. | |
| 6,585,933 B1 | | 7/2003 | Ehrhardt et al. | |
| 7,547,671 B2 | | 6/2009 | Kaneko et al. | |
| 2004/0038840 A1 | | 2/2004 | Lee et al. | |
| 2005/0245411 A1 | | 11/2005 | Yang et al. | |
| 2006/0112972 A1 | | 6/2006 | Peitersen et al. | |
| 2007/0075120 A1 | | 4/2007 | Yang et al. | |
| 2009/0065735 A1 | | 3/2009 | Kolics et al. | |
| 2010/0116473 A1 | | 5/2010 | Yang et al. | |
| 2010/0276629 A1 | * | 11/2010 | Woyciesjes | C09K 5/10 252/68 |
| 2011/0000505 A1 | * | 1/2011 | Yang | C11D 3/06 134/2 |

FOREIGN PATENT DOCUMENTS

WO WO 2012/116352 8/2010

OTHER PUBLICATIONS

Office action issued on Feb. 17, 2015 in related Chinese Appl. No. 201280010411.8.

Office action issued on Dec. 9, 2015 in related Russian Appl. No. 2013143293.

U.S. Appl. No. 13/404,577, filed Feb. 24, 2012.

Office action issued on Aug. 13, 2015 in related Chinese Appl. No. 201280010411.8.

Office action issued on Mar. 16, 2016, in related Russian Appl. No. 2013143293.

Int'l Search Report & Written Opinion of PCT/US2012/026668 dated Sep. 25, 2012.

Int'l Search Report & Written Opinion of PCT/US2012/025558, dated Sep. 25, 2012.

Office action issued on Jul. 15, 2016, in related Russian Appl. No. 2013143293.

Office action issued on Jul. 14, 2016, in related Chinese Appl. No. 201280010411.8.

Office action issued on Dec. 2, 2016, in related Chinese Appl. No. 201280010411.8.

Extended Search Report and Written Opinion issued on Jan. 12, 2017 in related European Appl. No. 12750132.8.

* cited by examiner

*Primary Examiner* — Gregory Webb

(74) *Attorney, Agent, or Firm* — Gregory H. Zayia; Barnes & Thornburg LLP

(57) ABSTRACT

Disclosed herein is a cleaner concentrate comprising: greater than 10 weight percent of a freezing point depressant, 0.5 to 35 weight percent of oxalic acid, and an azole compound, wherein weight percent is based on the total weight of the cleaner concentrate.

27 Claims, No Drawings

COMPOSITION FOR CLEANING A HEAT TRANSFER SYSTEM HAVING AN ALUMINUM COMPONENT

CROSS REFERENCE TO RELATED APPLICATION

This application is a continuation of U.S. patent application Ser. No. 13/404,577, filed Feb. 24, 2012, now U.S. Pat. No. 8,980,815, which claims the benefit of U.S. Provisional Patent Application Ser. No. 61/446,799, filed Feb. 25, 2011, the contents of which are incorporated herein by reference.

BACKGROUND

Automotive heat exchangers, such as radiators, heater cores, evaporators and condensers are predominantly made of aluminum alloys to reduce the weight of the vehicles. These heat exchangers can be the tube and fin type where the fins are corrugated and/slotted at right angles to the direction of airflow.

In the past, mechanical expansion techniques have been used for mass-production of automotive finned-tube heat exchangers. Heat exchangers are now predominantly formed by a brazing operation, wherein the individual components are permanently joined together with a brazing alloy.

Since the early 1980s, one brazing technique known as controlled atmosphere brazing (CAB) has become increasingly popular for use by automotive industry to make brazed aluminum heat exchangers. CAB has been preferred over a previous brazing method, i.e., vacuum furnace brazing, due to improved production yields, lower furnace maintenance requirements, greater braze process robustness, and lower capital cost of the equipment employed.

When manufacturing the heat exchangers using the CAB process, an aluminum brazing filler alloy (e.g., AA 4345 or AA 4043) is often pre-cladded or coated on at least one side of the core aluminum alloy sheet (or brazing sheet). Alternatively, a prebraze arc sprayed zinc coating is applied on the non-clad tubes (e.g., via a wire arc spraying process) to improve their corrosion resistance. The aluminum core alloys of the fins and tubes are typically AA 3003 or various "long life alloys" or modified AA 3003 alloys with additions of small amounts of elements typically selected from Cu, Mg, Mn, Ti, Zn, Cu, Cr and Zr.

In the CAB process, a fluxing agent is applied to the pre-assembled component surfaces to be jointed. During brazing at approximately 560 to 575° C., the fluxing agent starts to melt and the melted flux reacts, dissolves and displaces the aluminum oxide layer that naturally formed on the aluminum alloy surface and frees up the brazing filler alloy. The brazing filler alloy starts to melt at about 575 to 590° C. and begins to flow toward the joints to be brazed. During the cooling process, the filler metal solidifies and forms braze joints. The flux present on the surface also solidifies and remains on the surface as flux residue.

Additional functions of the fluxing agent are to prevent reformation of an aluminum oxide layer during brazing, enhance the flow of the brazing filler alloy, and increase base metal wettability. The fluxing agent is typically a mixture of alkaline metal fluoroaluminates with general formula $K_{1-3}AlF_{4-6}.xH_2O$, which is essentially a mixture of $K_3AlF_6$, $K_2AlF_5$ and $KAlF_4$. Fluoride-based fluxes are preferred over chloride-based fluxes for brazing aluminum or aluminum alloys because they are considered to be inert or non-corrosive to aluminum and its alloys, and substantially water insoluble after brazing. When the recommended flux coating weight (3-5 gram per square meter ($g/m^2$) for furnace brazing) is used, the CAB process is said to generate a 1-2 micrometers (μm) thick tightly adherent non-corrosive residue. Hence, it is believed that no removal of the flux residue is necessary after the brazing operation.

Due to the reported non-corrosive nature of the flux, its tolerance to brazing assembly fit-up and flexible control, CAB is one of the lowest cost methods for the joining of aluminum heat exchangers. It is now commonly used by the automotive and other industries for manufacturing of heat exchangers.

BRIEF SUMMARY

Recent studies conducted by us show that residues from potassium fluoroaluminate fluxes are soluble in commercial heat transfer fluids and will leach out fluoride and aluminum ions. These ions can enhance the corrosion of metals in the engine cooling system and/or degrade the heat transfer fluid corrosion protection and the heat transfer performance of the system. The amount of fluoride and aluminum ions that release into the heat transfer fluid depends on the chemical composition of the heat transfer fluid, the amount of flux loading, composition of the flux used, other variables involved in the brazing process, exposure time, as well as the operating conditions and design attributes of the cooling system. The extent of corrosion and degradation of heat transfer performance of the cooling system tend to increase with increasing exposure time.

The ion leaching and subsequent corrosion problems affect both new and used vehicles. In vehicles having a CAB aluminum component recently installed or about to be installed, it is desirable to prevent leaching and corrosion. In a used vehicle where the leaching and corrosion has already occurred, it is desirable to remove the corrosion products and protect against further corrosion. The presence of corrosion products can diminish heat transfer performance.

Thus, there is a need for compositions and methods to clean and remove the corrosion products or prevent their formation, to maintain or restore heat transfer fluid flow and heat transfer performance, to prevent corrosion damage or prevent or minimize additional corrosion damage and maintain heat transfer performance during the operation and lifetime of the vehicle cooling system containing controlled atmosphere brazed aluminum components.

The aforementioned need is addressed by a cleaning solution and a method for rapid cleaning of automotive cooling systems containing controlled atmosphere brazed aluminum heat exchangers. The method can optionally include a conditioning (passivating) step.

The method and treatment system are described in greater detail below.

DETAILED DESCRIPTION

It has been discovered that aluminum components made by CAB can be cleaned prior to coming in contact with a heat transfer fluid in a heat transfer system so as to reduce undesirable ion leaching from the flux and subsequent corrosion. Corrosion products may reduce heat transfer efficiency. In order to improve heat transfer fluid life, it can be desirable to passivate the heat transfer system prior to adding new heat transfer fluid and/or after cleaning and installing new parts in the heat transfer system. Passivation creates a protective film on the surfaces of the components of the heat transfer system, which protects the components against corrosion.

A method and composition for removing corrosion products from a heat transfer system comprising a CAB aluminum component is also disclosed herein. In order to improve heat transfer fluid life, it can be desirable to passivate the heat transfer system prior to adding new heat transfer fluid after cleaning the heat transfer system.

The cleaning solution can be made by diluting a cleaner concentrate. It is also envisioned that the cleaner concentrate can be used as the cleaning solution. The cleaner concentrate should have storage stability under a variety of conditions. Additionally the cleaning solution should have color stability when a dye is present.

The cleaner concentrate comprises greater than 15 weight percent of a freezing point depressant, 0.5 to 35 weight percent of oxalic acid, and an azole compound. Weight percent is based on the total weight of the cleaner concentrate. The cleaner concentrate may further comprise optional ingredients as described below. The balance of the composition can be provided by water.

Freezing point depressants include ethylene glycol, 1,2-propylene glycol (or 1,2-propanediol), 1,3-propanediol, glycerin (or 1,2,3-propanetriol) or combination comprising one or more of the foregoing freezing point depressants. Within the range described above the freezing point depressant can be present in an amount greater than or equal to 20 weight percent, or, more specifically, greater than or equal to 25 weight percent. The freezing point depressant can be present in an amount less than or equal to 99.4 weight percent, or, more specifically, less than or equal to 95 weight percent.

Within the range described above the oxalic acid may be present in an amount greater than or equal to 0.6 weight percent, or, more specifically, greater than or equal to 0.8 weight percent. Also within the range described above the oxalic acid may be present in an amount less than or equal to 30 weight percent, or, more specifically, less than or equal to 20 weight percent.

The cleaner can comprise a single azole compound or a combination of azole compounds. Azole compounds comprise a 5- or 6-member heterocyclic ring as a functional group, wherein the heterocyclic ring contains at least one nitrogen atom. Exemplary azole compounds include benzotriazole (BZT), tolyltriazole, methyl benzotriazole (e.g., 4-methyl benzotriazole and 5-methyl benzotriazole), butyl benzotriazole, and other alkyl benzotriazoles (e.g., the alkyl group contains from 2 to 20 carbon atoms), mercaptobenzothiazole, thiazole and other substituted thiazoles, imidazole, benzimidazole, and other substituted imidazoles, indazole and substituted indazoles, tetrazole and substituted tetrazoles, and mixtures thereof.

The cleaner can comprise the azole compound(s) in an amount of 0.01 to 20 weight percent based on the total weight of the cleaner concentrate. Within this range, the cleaner can comprise the azole compound(s) in an amount greater than or equal to 0.02 weight percent, or, more specifically, greater than or equal to 0.03 weight percent, or, more specifically, greater than or equal to 0.05 weight percent. Also within this range the azole compound(s) can be present in an amount less than or equal to 15 weight percent, or more specifically, less than or equal to 12 weight percent, or, more specifically, less than or equal to 10 weight percent.

The cleaner concentrate can optionally comprise maleic acid or maleic anhydride in an amount of 0 to 20 weight percent based on the total weight of the cleaner concentrate. Within this range, the maleic anhydride can be present in an amount greater than or equal to 0.1 weight percent, or, more specifically, greater than or equal to 0.5 weight percent. Also within this range the maleic anhydride can be present in an amount less than or equal to 10 weight percent, or, more specifically, less than or equal to five weight percent.

The cleaner concentrate can optionally comprise an organic phosphate ester such as Maxhib AA-0223, Maxhib PT-10T, or combination thereof. The organic phosphate ester can be present in an amount of 0 to 10 weight percent based on the total weight of the cleaner concentrate. Within this range, the organic phosphate ester can be present in an amount greater than or equal to 0.1 weight percent, or, more specifically, greater than or equal to 0.5 weight percent. Also within this range the organic phosphate ester can be present in an amount less than or equal to 10 weight percent, or, more specifically, less than or equal to 5 weight percent.

The cleaner concentrate can optionally comprise an organic acid having a pKa of less than or equal to 5.0 at 25° C. The organic acid is different from the oxalic acid and is also different from maleic acid. The organic acid can have a pKa of less than or equal to 4.5, or, more specifically, less than or equal to 4.0, or, more specifically, less than or equal to 3.5, or, more specifically less than or equal to 3.0, or, more specifically, less than or equal to 2.5, or, more specifically less than or equal to 2.0, all at 25° C. The organic acid can be an aliphatic or aromatic organic acid. In addition to containing carbon, hydrogen and oxygen atoms, the organic acid molecule can also contain from 0 to 4 sulfur atoms, 0 to 4 nitrogen atoms and/or 0 to 4 phosphorous atoms. The organic acid can comprise one or more carboxylic acid groups. One consideration in choosing an organic acid is the solubility in an aqueous system as the cleaner concentrate is combined with water to form an aqueous cleaning solution. Hence, the organic acid has to have sufficient solubility in the aqueous cleaning solution to be present in an amount in the cleaning solution such that cleaning can be completed in a timely manner, typically on a time scale of minutes or hours and usually less than 24 hours.

An additional consideration in choosing an organic acid is the efficiency of cleaning and the potential for corrosion. In some embodiments, it is desirable to select an organic acid, which results in cleaning in a short period of time (high efficiency). However, the efficiency of cleaning must be balanced with a low potential for causing corrosion.

Exemplary organic acids include taurine or 2-aminoethanesulfonic acid, cysteic acid, dihydroxytartaric acid, aspartic acid, 1,1-cyclopropanedicarboxylic acid, picric acid, picolinic acid, aconitic acid, carboxyglutamic acid, dihydroxmalic acid, 2,4,6-trihydroxybenzoic acid, 8-quinolinecarboxylic acid, and combinations of two or more of the foregoing acids. Also included are the anhydride equivalents of the foregoing organic acids. It is contemplated that combinations of organic acids and organic anhydrides can be used.

The cleaner concentrate can optionally comprise a combination of organic acids having a pKa of less than or equal to 5.0 at 25° C. The combination of organic acids can have a pKa of less than or equal to 4.5, or, more specifically, less than or equal to 4.0, or, more specifically, less than or equal to 3.5, or, more specifically less than or equal to 3.0, or, more specifically, less than or equal to 2.5, or, more specifically less than or equal to 2.0, all at 25° C. The organic acid(s) can be present in an amount of 0 to 20 weight percent based on the total weight of the cleaner concentrate. Within this range, the cleaner can comprise the organic acid(s) in an amount of 0.05 to 15 weight percent, or, more specifically 0.2 to 10 weight percent, or, more specifically, 0.5 to 8 weight percent.

The cleaner concentrate can optionally comprise an acrylic acid or maleic acid based polymer such as a polyacrylic acid, a polymaleic acid, or combination thereof. Also included are acrylic acid and maleic acid copolymers and terpolymers including those having sulfonate groups. Exemplary materials include Acumer 2000 and Acumer 3100. These polymers can be present in an amount of 0 to 5 weight percent, based on the total weight of the cleaner concentrate.

The cleaner concentrate can optionally comprise an additional corrosion inhibitor. Exemplary additional corrosion inhibitors include acetylenic alcohols, amides, aldehydes, imidazolines, soluble iodide compounds, pyridines, and amines. The additional corrosion inhibitor can be present in an amount of 0 to 10 weight percent based on the total weight of the cleaner concentrate.

The cleaner concentrate can further comprise a surfactant such as an ethylene oxide polymer or copolymer, a propylene oxide polymer or copolymer, a $C_8$-$C_{20}$ ethoxylated alcohol or combination thereof. Exemplary surfactants include Pluronic L-61, PM 5150, Tergitol 15-2-9 (CAS #24938-91-8), Tergitol 24-L-60 (CAS #68439-50-9) and Neodol 25-9 (CAS #68002-97-1). The surfactant can be present in an amount of 0 to 3 weight percent based on the total weight of the cleaner concentrate. Within this range, the surfactant can be present in an amount greater than or equal to 0.01 weight percent, or, more specifically, greater than or equal to 0.03 weight percent. Also within this range the surfactant can be present in an amount less than or equal to one weight percent.

The cleaner concentrate can further comprise a colorant such as a non-ionic colorant. Exemplary non-ionic colorants are available under the Liquitint© brand name from Milliken Chemicals.

The cleaner concentrate can further comprise one or more of the following: scale inhibitors, antifoams, biocides, polymer dispersants, and antileak agents such as attaclay and soybean meals.

The cleaner concentrate is in liquid form.

An exemplary cleaner concentrate comprises 5 to 10 weight percent of oxalic acid, 0.001 to 4 weight percent of an azole compound, 20 to 95 weight percent of ethylene glycol, 0 to 1 weight percent of surfactant, wherein weight percent is based on the total weight of the cleaner concentrate.

The cleaner concentrate can be diluted to form the cleaning solution by adding 0.5 to 5 parts (typically by volume) of water to 1 part cleaner concentrate. The cleaning solution, when made by diluting the cleaner concentrate can comprise 0.5 to 90 weight percent of a freezing point depressant, greater than or equal to 0.01 weight percent of oxalic acid, and greater than or equal to 0.001 of an azole compound, based on the total weight of the cleaning solution. In a more specific embodiment the cleaning solution comprises greater than 10 vol % of a freezing point depressant, greater than or equal to 0.01 weight percent of oxalic acid, and greater than or equal to 0.001 of an azole compound, based on the total volume and total weight of the cleaning solution.

Typically, any heat transfer fluid present in the heat transfer system is drained prior to cleaning. The heat transfer system can be flushed with water prior to adding the cleaning solution to the heat transfer system and drained. Some heat transfer systems are difficult to drain and retain a significant amount of the previously circulated fluid. The heat transfer system is filled with the cleaning solution. The engine is started and run for a period of time, which can be for a few minutes to several hours. The cleaning solution can be recirculated. The cleaning solution can be recirculated by an internal pump (i.e., the water pump in a vehicle engine) and/or one or more external pumps. Alternatively, the cleaning solution can be gravity fed into the system. Additionally, a filter, such as a bag filter, can be used during the recirculation of the cleaning solution. The filter can be installed in a side stream of the recirculation loop or in a location of the system so that it can be removed or exchange easily during the cleaning process without interruption of the circulation of the cleaning solution in the main part of the system. The filter can have openings or pore size of 10 micrometers to 200 micrometers. After the cleaning is completed, the engine is shut off and the cleaning solution is drained from the system and the system is flushed with water.

An exemplary cleaning procedure utilizes an external pump and a fluid reservoir open to atmospheric pressure. The external pump and fluid reservoir are used to circulate fluid through an automotive cooling system. The heat transfer system is flushed of heat transfer fluid and filled with water. The thermostat is removed and a modified thermostat is installed to simulate an "open" thermostat condition. The procedure utilizes a reverse flow design through the heater core and ensures flow through the heater core. Gas generated in the system is purged through the system and discharged into the reservoir. The external pump draws cleaning solution from the reservoir, sends it into the heater core outlet, through the heater core, out of the heater core inlet hose, and into the heater outlet nipple on the engine. A discharge hose is connected from the heater inlet nipple on the engine back to the reservoir. An optional filter may be used on the discharge hose into the reservoir to capture any cleaned debris. The vehicle engine is used to develop heat in the cleaning solution, but can only be run as long as the temperature of the cleaning solution remains below the boiling point. The system can be allowed to cool and the engine can optionally be restarted to reheat the solution but again the engine is only run as long as the temperature of the cleaning solution remains below the boiling point. The cleaning solution in the reservoir can be replaced between heating and cooling cycles. Additional cleaning solution can be added during a heating cycle to keep the temperature of the cleaning solution below the boiling point. The cooling step and reheating step can be repeated until the system is considered clean. The cleanliness of the system can be evaluated on the basis of the appearance of the cleaning solution. After circulating the cleaning solution, the heat transfer system is flushed with water.

A conditioner can be used to passivate the heat transfer system after cleaning with the cleaning solution. The conditioner can comprise water, a water soluble alkaline metal phosphates, such as sodium phosphate or potassium phosphate, in an amount of 0.2 to 15 weight percent, one or more azole compounds in an amount of 0.05 to 5 weight percent, and optional components, such as corrosion inhibitors, scale inhibitors, acid neutralizers, colorants, surfactants, antifoams, stop-leak agents (i.e., attaclay or soybean meals) etc. Amounts in this paragraph are based on the total weight of the conditioner.

The pH of the conditioner can be greater than or equal to 7.5 at room temperature (15 to 25° C.), or, more specifically, greater than or equal to 8.0, or, more specifically 8.5 to 11.

The conditioner is introduced to the heat transfer system in a method the same as or similar to that of the cleaning solution. Similar to the cleaning solution the conditioner should be circulated at a temperature less than the boiling temperature of the conditioner. The temperature of the conditioner can be between ambient and 80° C.

After the optional conditioner is removed and flushed from the heat transfer system the heat transfer fluid is added.

The heat transfer fluid can be a glycol based heat transfer fluid comprising an aliphatic carboxylic acid or salt thereof and/or an aromatic carboxylic acid. The heat transfer fluid can further comprise an azole, a phosphate, or a combination thereof. In addition, the heat transfer fluid can also contain water, one or more glycol based freeze point depressants, and an optional pH-adjusting agent to adjust the pH of the heat transfer fluid to between 7.5 to 9.0.

An exemplary heat transfer fluid for use as the refill heat transfer fluid in vehicle cooling systems comprises a freezing point depressant in an amount of 10 to 99 weight percent based on the total weight of the heat transfer fluid; deionized water; and a corrosion inhibitor package.

The freezing point depressant suitable for use includes alcohols or mixture of alcohols, such as monohydric or polyhydric alcohols and mixture thereof. The alcohol is selected from the group consisting of methanol, ethanol, propanol, butanol, furfurol, furfuryl alcohol, tetrahydrofurfuryl alcohol, ethoxylated furfuryl alcohol, ethylene glycol, diethylene glycol, triethylene glycol, 1,2-propylene glycol, 1,3-propylene glycol, dipropylene glycol, butylene glycol, glycerol, glycerol-1,2-dimethyl ether, glycerol-1,3-dimethyl ether, monoethylether of glycerol, sorbitol, 1,2,6-hexanetriol, trimethylopropane, alkoxy alkanols such as methoxyethanol and mixture thereof. The freezing point depressant is present in the composition in an amount of about 10 to about 99 weight percent based on the total weight of the heat transfer fluid. Within this range, the freezing point depressant can be present in an amount of 30 to 99 weight percent, or, more specifically 40 to 99 weight percent.

Water suitable for use includes deionized water or demineralized water. The water is present in the heat transfer fluid in an amount of about 0.1 to about 90 weight percent, or, more specifically, 0.5 to 70 weight percent, or even more specifically 1 to 60 weight percent based on the total weight of the heat transfer fluid.

The corrosion inhibitor package can comprise a mono or dibasic aliphatic ($C_6$ to $C_{15}$) carboxylic acids, the salt thereof, or the combination thereof. Exemplary mono or dibasic aliphatic carboxylic acids include 2-ethyl hexanoic acid, neodecanoic acid, and sebacic acid.

The corrosion inhibitor package can comprise an inorganic phosphate such as phosphoric acid, sodium or potassium orthophosphate, sodium or potassium pyrophosphate, and sodium or potassium polyphosphate or hexametaphosphate. The phosphate concentration in the heat transfer fluid can be 0.002 to 5 weight percent, or, more specifically 0.01 to 1 weight percent, based on the total weight of the heat transfer fluid.

The corrosion inhibitor package can comprise a water-soluble magnesium compound, such as magnesium nitrate and magnesium sulfate, that results in magnesium ions in the heat transfer fluid. The magnesium ion concentration in the formulation can be 0.5 to 100 ppm Mg.

The corrosion inhibitor package can comprise at least one component selecting from the following (1) azole compounds or other copper alloy corrosion inhibitors; (2) phosphonocarboxylic acid mixture such as Bricorr 288; and (3) phosphinocarboxylic acid mixture, such as PSO.

Corrosion inhibitors for copper and copper alloys can also be included. The suitable copper and copper corrosion inhibitors include the compounds containing 5- or 6-member heterocyclic ring as the active functional group, wherein the heterocyclic ring contains at least one nitrogen atom, for example, an azole compound. Exemplary azole compounds include benzotriazole, tolyltriazole, methyl benzotriazole (e.g., 4-methyl benzotriazole and 5-methyl benzotriazole), butyl benzotriazole, and other alkyl benzotriazoles (e.g., the alkyl group contains from 2 to 20 carbon atoms), mercaptobenzothiazole, thiazole and other substituted thiazoles, imidazole, benzimidazole, and other substituted imidazoles, indazole and substituted indazoles, tetrazole and substituted tetrazoles, and mixtures thereof. The copper and copper alloy corrosion inhibitors can be present in the composition in an amount of about 0.01 to 4% by weight, based on the total weight of the heat transfer fluid.

The heat transfer fluid can further comprise other heat transfer fluid additives, such as colorants, other corrosion inhibitors not listed above, dispersants, defoamers, scale inhibitors, surfactants, colorants, and antiscalants, wetting agents and biocides, etc.

Optional corrosion inhibitors include one or more water soluble polymers (MW: 200 to 200,000 Daltons), such as polycarboxylates, e.g., polyacrylic acids or polyacrylates, acrylate based polymers, copolymers, terpolymers, and quadpolymers, such as acrylate/acrylamide copolymers, polymethacrylates, polymaleic acids or maleic anhydride polymers, maleic acid based polymers, their copolymers and terpolymers, modified acrylamide based polymers, including polyacrylamides, acrylamide based copolymers and terpolymers; In general, water soluble polymers suitable for use include homo-polymers, copolymers, terpolymer and inter-polymers having (1) at least one monomeric unit containing $C_3$ to $C_{16}$ monoethylenically unsaturated mono- or dicarboxylic acids or their salts; or (2) at least one monomeric unit containing $C_3$ to $C_{16}$ monoethylenically unsaturated mono- or dicarboxylic acid derivatives such as amides, nitriles, carboxylate esters, acid halides (e.g., chloride), and acid anhydrides, and combination thereof. Examples of monocarboxylic acids for making the water-soluble polymers include acrylic acid, methacrylic acid, ethacrylic acid, vinylacetic acid, allylacetic acid, and crotonic acid. Examples of monocarboxylic acid ester suitable for use include butyl acrylate, n-hexyl acrylate, t-butylaminoethyl methacrylate, diethylaminoethyl acrylate, hydroxyethyl methacrylate, hydrxypropyl acrylate, hydroxypropyl methacrylate, diethylaminoethyl methacrylate, dimethylaminoethyl methacrylate, dimethylaminoethyl acrylate, methyl acrylate, methyl methacrylate, tertiary butylacrylate, and vinyl acetate. Examples of dicarboxylic acids include maleic acid, itaconic acid, fumaric acid, citaconic acid, mesaconic acid, and methylenemalonic acid. Examples of amides include acrylamide (or 2-propenamide), methacrylamide, ethyl acrylamide, propyl acrylamide, tertiary butyl methacrylamide, tertiary octyl acrylamide, N,N-dimethylacrylamide (or N, N-dimethyl-2-propenamide), dimethylaminopropyl methacrylamide, cyclohexyl acrylamide, benzyl methacrylamide, vinyl acetamide, sulfomethylacrylamide, sulfoethylacrylamide, 2-hydroxy-3-sulfopropyl acrylamide, sulfophenylacrylamide, N-vinyl formamide, N-vinyl acetamide, 2-hydroxy-3-sulfopropyl acrylamide, N-vinyl pyrrolidone (a cyclic amide), carboxymethylacrylamide. Examples of anhydrides include maleic anhydride (or 2,5-furandione) and succinic anhydride. Examples of nitriles include acrylonitrile and methacrylonitrile. Examples of acid halides include acrylamidopropyltrimethylammonium chloride, diallyldimethylammonium chloride, and methacrylamidopropyltrimethylammonium chloride. In addition, water-soluble polymers containing at least one monomeric unit of the following additional monomer may also be used. The additional monomers may be selected from the group consisting of allylhydroxypropylsulfonate, AMPS or 2-acrylamido-2-methylpropane sulfonic acid, polyethyleneglycol monomethacrylate, vinyl sulfonic acid, styrene sulfonic acid, acrylamidomethyl propane sulfonic acid, methallyl sulfonic acid, allyloxybenzenesulfonic acid, 1,2-dihydroxy-3-butene, allyl alcohol, allyl phosphonic acid, ethylene glycoldiacrylate, aspartic acid, hydroxamic acid, 2-ethyl-oxazoline, adipic acid, diethylenetriamine, ethylene oxide, propylene oxide, ammonia, ethylene diamine, dimethylamine, diallyl phthalate, 3-allyloxy-2hydroxy propane sulfonic acid, polyethylene glycol monomethacrylate, sodium styrene sulfonate, alkoxylated allyl alcohol sulfonate having the following structure:

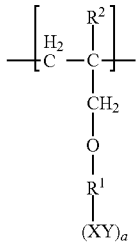

where $R^1$ is a hydroxyl substituted alkyl or alkylene radical having from 1 to about 10 carbon atoms, or a non-substituted alkyl or alkylene radical having from 1 to about 10 carbon atoms, or is $(CH_2—CH_2—O)_n$, $[CH_2—CH(CH_3)—O]_n$ or a mixture of both and "n" is an integer from about 1 to about 50; $R^2$ is H or lower alkyl ($C_1$-$C_3$) group; X, when present, is an anionic radical selected from the group consisting of $SO_3$, $PO_3$, $PO_4$, COO; Y, when present, is H or hydrogens or any water soluble cation or cations which together counter-balance the valance of the anionic radical; a is 0 or 1. The amount of the water-soluble polymer in the heat transfer fluid can be about 0.005 to 10 weight percent, based on the total weight of the heat transfer fluid. The water-soluble polymer may also be either polyether polyamino methylene phosphonate, as described in U.S. Pat. No. 5,338,477, or phosphino polyacrylate acids.

Optional corrosion inhibitors can include one or more aliphatic tri-carboxylic acids (e.g., citric acid) or aliphatic tetra-carboxylic acids, such as 1,2,3,4-alkane tetra-carboxylic acids, and preferably, 1,2,3,4-butane tetra-carboxylic acid. The water-soluble salts, esters or anhydrides of aliphatic tetra-carboxylic acids can also be used. The concentration can be about 0.001 to 5 weight percent based on the total weight of the heat transfer fluid.

Optional corrosion inhibitors can also include at least one of molybdates, nitrates, nitrite, phosphonates, such as 2-phosphono-butane-1,2,4-tricarboxylic acid, amine salts, and borates.

Optional corrosion inhibitors can include at least one metal ion (e.g., in water-soluble salt form) selecting from calcium, strontium, and/or zinc salts or combination thereof. The water-soluble metal ion concentration can be 0.1 milligram per liter (mg/1) to about 100 mg/1 in the heat transfer fluid.

It is contemplated that in some embodiments the heat transfer fluid is free of silicate.

Some non-ionic surfactants may also be included as corrosion inhibitors. Exemplary non-ionic surfactants include fatty acid esters, such as sorbitan fatty acid esters, polyalkylene glycols, polyalkylene glycol esters, copolymers of ethylene oxide (EO) and propylene oxide (PO), polyoxyalkylene derivatives of a sorbitan fatty acid ester, and mixtures thereof. The average molecular weight of the non-ionic surfactants can be about 55 to about 300,000, specifically about 110 to about 10,000. Suitable sorbitan fatty acid esters include sorbitan monolaurate (e.g., sold under tradename Span® 20, Arlacel® 20, S-MAZ® 20M1), sorbitan monopalmitate (e.g., Span® 40 or Arlacel® 40), sorbitan monostearate (e.g., Span® 60, Arlacel® 60, or S-MAZ® 60K), sorbitan monooleate (e.g., Span® 80 or Arlacel® 80), sorbitan monosesquioleate (e.g., Span® 83 or Arlacel® 83), sorbitan trioleate (e.g., Span® 85 or Arlacel® 85), sorbitan tridtearate (e.g., S-MAZ® 65K), sorbitan monotallate (e.g., S-MAZ® 90). Exemplary polyalkylene glycols include polyethylene glycols, polypropylene glycols, and mixtures thereof. Examples of polyethylene glycols include CARBOWAX™ polyethylene glycols and methoxypolyethylene glycols from Dow Chemical Company, (e.g., CARBOWAX PEG 200, 300, 400, 600, 900, 1000, 1450, 3350, 4000 & 8000, etc.) or PLURACOL® polyethylene glycols from BASF Corp. (e.g., Pluracol® E 200, 300, 400, 600, 1000, 2000, 3350, 4000, 6000 and 8000, etc.). Exemplary polyalkylene glycol esters include mono- and di-esters of various fatty acids, such as MAPEG® polyethylene glycol esters from BASF (e.g., MAPEG® 200ML or PEG 200 Monolaurate, MAPEG® 400 DO or PEG 400 Dioleate, MAPEG® 400 MO or PEG 400 Monooleate, and MAPEG® 600 DO or PEG 600 Dioleate, etc.). Suitable copolymers of ethylene oxide (EO) and propylene oxide (PO) include various Pluronic and Pluronic R block copolymer surfactants from BASF, DOWFAX non-ionic surfactants, UCON™ fluids and SYNALOX lubricants from DOW Chemical. Suitable polyoxyalkylene derivatives of a sorbitan fatty acid ester include polyoxyethylene 20 sorbitan monolaurate (e.g., products sold under trademarks TWEEN 20 or T-MAZ 20), polyoxyethylene 4 sorbitan monolaurate (e.g., TWEEN 21), polyoxyethylene 20 sorbitan monopalmitate (e.g., TWEEN 40), polyoxyethylene 20 sorbitant monostearate (e.g., TWEEN 60 or T-MAZ 60K), polyoxyethylene 20 sorbitan monooleate (e.g., TWEEN 80 or T-MAZ 80), polyoxyethylene 20 tristearate (e.g., TWEEN 65 or T-MAZ 65K), polyoxyethylene 5 sorbitan monooleate (e.g., TWEEN 81 or T-MAZ 81), polyoxyethylene 20 sorbitan trioleate (e.g., TWEEN 85 or T-MAZ 85K) and the like.

In addition, the corrosion inhibitor in the heat transfer fluid may also include one or more of the following compounds: amine salts of cyclohexenoic carboxylate compounds derived from tall oil fatty acids; amine compounds, such as mono-, di- and triethanolamine, morpholine, benzylamine, cyclohexylamine, dicyclohexylamine, hexylamine, AMP (or 2-amino-2-methyl-1-propanol or isobutanolamine), DEAE (or diethylethanolamine), DEHA (or diethylhydroxylamine), DMAE (or 2-dimethylaminoethanol), DMAP (or dimethylamino-2-propanol), and MOPA (or 3-methoxypropylamine).

A number of polydimethylsiloxane emulsion based antifoams can be used in the instant invention. They include PC-5450NF from Performance Chemicals, LLC in Boscawen, N.H., and CNC antifoam XD-55 NF and XD-56 from CNC International in Woonsocket in R.I. Other antifoams suitable for use in the instant invention include copolymers of ethylene oxide (EO) and propylene oxide (PO), such as Pluronic L-61 from BASF.

Generally, the optional antifoam agents may comprise a silicone, for example, SAG 10 or similar products available from OSI Specialties, Dow Corning or other suppliers; an ethylene oxide-propylene oxide (EO-PO) block copolymer and a propylene oxide-ethylene oxide-propylene oxide (PO-EP-PO) block copolymer (e.g., Pluronic L61, Pluronic L81, or other Pluronic and Pluronic C products); poly(ethylene oxide) or poly(propylene oxide), e.g., PPG 2000 (i.e., polypropylene oxide with an average molecular weight of 2000); a hydrophobic amorphous silica; a polydiorganosiloxane based product (e.g., products containing polydimethylsiloxane (PDMS), and the like); a fatty acids or fatty acid ester (e.g., stearic acid, and the like); a fatty alcohol, an alkoxylated alcohol and a polyglycol; a polyether polylol acetate, a polyether ethoxylated sorbital hexaoleate, and a poly (ethylene oxide-propylene oxide) monoallyl ether acetate; a wax, a naphtha, kerosene and an aromatic oil; and combinations comprising one or more of the foregoing antifoam agents.

Exemplary heat transfer fluids are also described in U.S. Patent Publication Nos. 2010/0116473 A1 and 2007/0075120 A1, which are incorporated by reference herein in their entirety.

The above-described methods and compositions are further illustrated by the following non-limiting examples.

EXAMPLES

In the Examples that follow, the balance of the described compositions is deionized water.

Several compositions were made and then tested for storage stability. Compositions, storage conditions and observations are shown in Table 1.

TABLE 1

| Ingredients | Ex. 1* | Ex. 2 | Ex. 3 | Ex. 4 |
|---|---|---|---|---|
| oxalic acid dihydrate | 8.0000 | 8.0016 | 8.0005 | 8.0006 |
| 20 wt % benzotriazole in ethylene glycol | 3.0000 | 3.0018 | 3.0028 | 3.0019 |
| Pluronic L-61 antifoam/ surfactant | 0.0500 | 0.0501 | 0.0501 | 0.0505 |
| Ethylene Glycol | 0.0000 | 44.4737 | 35.5788 | 26.6848 |
| Deionized Water | 88.9499 | 44.4727 | 53.3677 | 62.2622 |
| Total weight | 100.0000 | 100.0000 | 100.0000 | 100.0000 |
| Total Ethylene Glycol, wt % | 2.4000 | 46.8752 | 37.9811 | 29.0863 |
| Observations after stored for approximately 65 hours at 55° F. | A small amount of precipitate observed on the bottom of the glass container | Solution uniform, no solid phase or particulates observed | Solution uniform, no solid phase or particulates observed | A small amount of particulates is present, coating the bottom of the glass container |
| Observations after stored for 24 hours at 10° F. | The solution turned into milky white solid with a slight yellow tone | Solution uniform; no solid phase, particulates or precipitate observed | Solution uniform; no solid phase, particulates or precipitate observed | A large amount of fibrous milky white crystals coating the bottom of the bottle. Liquid phase is clear |
| Observations after allowing the samples to thaw and return to room temperature | Solid and liquid phases observed; solid phase is milky white crystals. Liquid phase is clear. Shaking vigorously for about 30 seconds reduced the amount of solid, but more than 50% of the solid remains. | No change | No Change | A small amount of milky white crystals remained. The crystals dissolved completely into the solution after shaking vigorously for about 30 seconds. |

| Ingredients | Ex. 5 | Ex. 6 | Ex. 7 | Ex. 8 |
|---|---|---|---|---|
| oxalic acid dihydrate | 8.0017 | 8.0015 | 8.0006 | 8.0016 |
| 20 wt % benzotriazole in ethylene glycol | 3.0009 | 3.0018 | 3.0009 | 3.0018 |
| Pluronic L-61 antifoam/ surfactant | 0.0503 | 0.0506 | 0.0504 | 0.0506 |
| Ethylene Glycol | 17.7892 | 53.3675 | 62.2632 | 71.1570 |
| Deionized Water | 71.1579 | 35.5786 | 26.6848 | 17.7890 |
| Total weight | 100.0000 | 100.0000 | 100.0000 | 100.0000 |
| Total Ethylene Glycol, wt % | 20.1899 | 55.7689 | 64.6639 | 73.5585 |
| Observations after stored for approximately | A moderate amount of particulates is | Solution uniform and clear; no solid | Solution uniform and clear; no solid | Solution uniform and clear; no |

TABLE 1-continued

| | | | | |
|---|---|---|---|---|
| 65 hours at 55° F. | present, coating the bottom of the glass container | phase, particulates or precipitate observed | phase, particulates or precipitate observed | solid phase, particulates or precipitate observed |
| Observations after stored for 24 hours at 10° F. | A large amount of fibrous milky white crystals coating the bottom of the bottle. Liquid phase is clear. | Solution uniform and clear; no solid phase, particulates or precipitate observed | Solution uniform and clear; no solid phase, particulates or precipitate observed | Solution uniform and clear; no solid phase, particulates or precipitate observed |
| Observations after allowing the samples to thaw and return to room temperature | A large amount of milky white crystals remained. The crystals dissolved completely into the solution after shaking vigorously for about 30 seconds. | No Change | No Change | No Change |

| Ingredients | Ex. 9 | Ex. 10 |
|---|---|---|
| oxalic acid dihydrate | 7.9997 | 8.0016 |
| 20 wt % benzotriazole in ethylene glycol | 3.0009 | 3.0008 |
| Pluronic L-61 antifoam/ surfactant | 0.0504 | 0.0505 |
| Ethylene Glycol | 80.0543 | 88.9471 |
| Deionized Water | 8.8947 | 0.0000 |
| Total weight | 100.0000 | 100.0000 |
| Total Ethylene Glycol, wt % | 82.4550 | 91.3477 |
| Observations after stored for approximately 65 hours at 55° F. | Solution uniform and clear; no solid phase, particulates or precipitate observed | Solution uniform and clear; no solid phase, particulates or precipitate observed |
| Observations after Stored for 24 hours at 10° F. | Solution uniform and clear; no solid phase, particulates or precipitate observed | Solution uniform and clear; no solid phase, particulates or precipitate observed |
| Observations after allowing the samples to thaw and return to room temperature | No Change | No Change |

*Comparative Example

Examples 1-10 show that increasing amounts of ethylene glycol results in better storage stability.

Example 11

Example 11 demonstrates the color stability in the cleaning composition. Color stability tests include the following conditions—test duration was approximately 20 hours for each condition. Formation of insoluble particulates or precipitate, and discoloration or substantial color change during the test indicates that the dye is not stable in the formulation under the test conditions and the formulation is considered to be not stable under the conditions. The overall color stability test result is designated as fail if the formulation did not yield satisfactory test results in any of the test conditions.

1. Room temperature storage stability
2. 100° F. storage stability
3. 140° F. storage stability
4. Room temperature storage stability in the presence of a cast aluminum (UNS A23190) coupon
5. 100° F. storage stability in the presence of a cast aluminum (UNS A23190) coupon
6. 140° F. storage stability in the presence of a cast aluminum (UNS A23190) coupon 7. Room temperature storage stability in the presence of a section of radiator tube containing potassium fluoride flux residues
8. 100° F. storage stability in the presence of a section of radiator tube containing potassium fluoride flux residues
9. 140° F. storage stability in the presence of a section of radiator tube containing potassium fluoride flux residues Composition and results are shown in Table 2. Amounts are in weight percent based on the total weight of the composition.

TABLE 2

| | |
|---|---|
| Oxalic acid dihydrate, Technical grade | 7.9906 |
| 20% Benzotriazole in Ethylene Glycol | 2.9966 |
| Pluronic L-61 antifoam/surfactant | 0.0501 |
| D11013X Chromatint Yellow 0963 | 0.0500 |
| Deionized Water | 88.9127 |
| Total | 100.0000 |

TABLE 2-continued

| | |
|---|---|
| Total Ethylene Glycol, wt % | 2.3973 |
| Formulation Color Stability Test Result | Pass |

Examples 12-21

Aluminum heat exchanger tubes (type #1) blocked with corrosion products from an automotive heat transfer system having CAB aluminum components (which were not cleaned prior to installation) were exposed to various cleaning solutions for evaluation as described in Table 3. The cleaning solution was analyzed by inductively coupled plasma mass spectrometry (ICP) before and after exposure to the blocked tubes. The tubes were cut open on one side prior to testing so that the cleaning fluid, heated to about 90° C., was applied by a pipette streaming solution over the opened tube interior surface. The appearance of the tube was visually evaluated before and after cleaning.

TABLE 3

| | Cleaning Conditions | | | | | |
|---|---|---|---|---|---|---|
| | Example 12 50 g of 2 wt % Oxalic acid dihydrate + 0/15 wt % BZT (from 20% BZT in EG) + 0.0125% Pluronic L-61 + 0.0125% Liquitint Patent Blue, 75 +– 2 C., cleaner added via a pipet for 30 min. | | Example 13 Add 50% NaOH to 100 ml of (2 wt % Oxalic acid dihydrate + 0.15 wt % BZT (from 20% BZT in EG) + 0.0125 wt % Pluronic L-61 + 0.0125 wt % D11013X Chromatint Yellow 0963. This solution was prepared by mixing 1 part of cleaner formulation "11" in Table 2 with 3 parts of deionized water) to adjust pH to 2.52, => Solujtion "A" was used as the cleaning solution. 75 ± 2° C., cleaning solution added via a pipet for 45 min. Tube completely clean at end-of-test. Test Stopped at 45 min. | | Example 14 Add 50% NaOH to 100 ml of (2 wt % Oxalic acid dihydrate + 0.15 wt % BZT (from 20% BZT in EG) + 0.0125 wt % Pluronic L-61 + 0.0125 wt % D11013X Chromatint Yellow 0963. This solution was prepared by mixing 1 part of cleaner concentrate formulation "11" described in Table 2 with 3 parts of deionized water.) to adjust pH to 3.5, => Solution "B"), 50 ml of Solution "B" was used as the cleaning solution. 75 ± 2° C., cleaning solution added via a pipet for 70 min. Tube >95% clean at end-of-test. Test Stopped at 70 min. | |
| ICP | Before mg/L | After mg/L | Before mg/L | After mg/L | Before mg/L | After mg/L |
| Al | <2 | 770 | <2 | 750 | <2 | 860 |
| B | <2 | 69 | <2 | 45 | <2 | 48 |
| Ca | 2.7 | 5.6 | 4.6 | 2.9 | 2 | 2.2 |
| Cu | <2 | <2 | <2 | <2 | <2 | <2 |
| Fe | <2 | 2.9 | <2 | 3 | <2 | 2.8 |
| K | <2 | 42 | <2 | 130 | <2 | 190 |
| Mg | <2 | 3.8 | <2 | 3.3 | <2 | 3.5 |
| Mo | <2 | <2 | <2 | <2 | <2 | <2 |
| Na | 4 | 180 | 3700 | 3200 | 4800 | 3800 |
| P | <2 | 5.6 | <2 | 4.4 | <2 | 4.4 |
| Pb | <2 | <2 | <2 | <2 | <2 | <2 |
| Si | <2 | 56 | <2 | 36 | <2 | 42 |
| Sr | <2 | <2 | <2 | <2 | <2 | <2 |
| Zn | <2 | 19 | <2 | 14 | <2 | 15 |
| Deposit on Tube Surface and cleaning results | 100% of the tube surface covered with deposits | All deposits were removed. Dye appears to be stable | 100% of the tube surface covered with deposits | All deposits were removed. Dye appeared to be stable | 100% of the tube surface covered with deposits | >95% of the deposits on the tube surface were removed. Dye appeared to be stable |
| pH, as is | 1.5 | NA | 2.6 | 3 | 3.4 | 6.4 |
| EG, vol % | NA | NA | NA | NA | NA | NA |

TABLE 3-continued

| | Cleaning Conditions | | | | | | | |
|---|---|---|---|---|---|---|---|---|
| | Example 15 50 g cleaning solution containing 2 wt % Oxalic Acid dihydrate + 0.15 wt % benzotriazole (from 20 wt % BZT in EG) + 0.0125 wt % Pluronic L-61 + 11.72 wt % Ethylene glycol. The remainder is DI water, Prepared by mixing 1 part of Cleaner Formulation "2" described in Table 1 with 3 parts of DI water. Solution added by a pipet to a syringe with needle inserted into one end of the heater core tube. Cleaning solution temperature = 75 +– 2 C. Cleaning time was 30 minutes. | | Example 16 50 g cleaning solution containing 2 wt % Oxalic Acid dihydrate + 0.15 wt % benzotriazole (from 20 wt % BZT in EG) + 0.0125 wt % Pluronic L-61 + 0.0125 wt % D11013X Chromatint Yellow 0963 + 2.397 wt % ethylene glycol. The remainder of the cleaning solution is deionized water. Cleaning solution prepared by mixing 1 part of Cleaner Formulation "6" described in Table 1 and three parts of DI water. Solution added by a pipet to a syringe with needle inserted into one end of the heater core tube. Cleaning solution temperature = 75 +– 2 C. Cleaning time was 32 minutes. | | Example 17* 50 g of citric acid based solution (2 wt % citric acid + 0.1 wt % BZT + 97.9 wt % DI H2O). Cleaning solution added by a pipet to one end of the opened heat core tube. Contact time = 70 min. | | Example 18* 50 g of 2-phosphono butane-1,2,4-tricarboxylic acid (PBTC) based cleaning solution (96 g DI water + 4 g Bayhibit AM, 50% PBTC). Cleaning solution added by a pipet to one end of the opened heat core tube. Contact time = 30 min. | |
| ICP | Before mg/L | After mg/L | Before mg/L | After mg/L | Before mg/L | After mg/L | Before mg/L | After mg/L |
| Al | <2 | 920 | 3 | 1000 | <2 | 570 | <2 | 420 |
| B | <2 | 57 | <2 | 58 | <2 | 51 | <2 | 51 |
| Ca | <2 | 3.1 | <2 | 6 | <2 | 5.4 | <2 | 3.2 |
| Cu | <2 | <2 | <2 | <2 | <2 | <2 | <2 | <2 |
| Fe | <2 | 4 | <2 | 4.4 | <2 | 2.1 | <2 | <2 |
| K | <2 | 140 | <2 | 65 | <2 | 71 | <2 | 87 |
| Mg | <2 | 3.7 | <2 | 3.8 | <2 | 3.3 | <2 | 2.3 |
| Mo | <2 | <2 | <2 | <2 | <2 | <2 | <2 | <2 |
| Na | <2 | 150 | 3.2 | 160 | 2.6 | 130 | 120 | 250 |
| P | <2 | 5.5 | <2 | 5.1 | <2 | 3.9 | 2300 | 2000 |
| Pb | <2 | <2 | <2 | <2 | <2 | <2 | <2 | <2 |
| Si | <2 | 51 | <2 | 55 | <2 | 53 | <2 | 44 |
| Sr | <2 | <2 | <2 | <2 | <2 | <2 | <2 | <2 |
| Zn | <2 | 18 | <2 | 22 | <2 | 18 | <2 | 14 |
| Deposit on Tube Surface and cleaning results | 100% of the tube surface covered with deposits | All deposits were removed. | 100% of the tube surface covered with deposits | All deposits were removed. | 100% of the tube surface covered with deposits | About 70% of the deposits was removed | 100% of the tube surface covered with deposits | About 65% of the deposit was removed |
| pH, as is | 1.5 | 1.5 | 1.5 | 1.5 | 2.3 | 2.6 | 1.8 | 2.1 |
| EG, vol % | 12.7 | 12.6 | 2.8 | 4.3 | 2.9 | 3.6 | 3.1 | 4 |

| | Cleaning Conditions | | | | | |
|---|---|---|---|---|---|---|
| | Example 19 50 g cleaning solution containing 2 wt % Oxalic Acid dihydrate + 0.15 wt % benzotriazole (from 20 wt % BZT in EG) + 0.0125 wt % Pluronic L-61 + 20.01 wt % Ethylene glycol. The remainder is DI water, Prepared by mixing 1 part of Cleaner Formulation "9" in Table 1 with 3 parts of DI water. Solution added by a pipet to to the opened heater core tube. Cleaning solution temperature = 75+– 2 C. Cleaning time was 30 minutes.. | | Example 20 50 g cleaning solution containing 2 wt % Oxalic Acid dihydrate + 0.15 wt % benzotriazole (from 20 wt % BZT in EG) + 0.0125 wt % Pluronic L-61 + 22.24 wt % Ethylene glycol. The remainder is DI water, Prepared by mixing 1 part of Cleaner formulation "10" described in Table 1 with 3 parts of DI water. Solution added by a pipet to one end of the opened heater core tube. Cleaning solution temperature = 75 +– 2 C. Cleaning time was 36 minutes. | | Example 21 250 ml cleaning test solution containing 3.779 wt % Oxalic Acid dihydrate + 0.283 wt % benzotriazole (from 20 wt % BZT in EG) + 0.0239 wt % Pluronic L-61 + 43.15 wt % Ethylene glycol. The remainder is DI water. Prepared by mixing 335 g cleaner formulation "10" described in Table 1 with 362 g DI water and 12.4 g NaOH, 50% to adjust pH => Test solution. The test solution added by a pipet to one end of the opened heater core tube. Cleaning solution temperature = 75 +– 2 C. Cleaning time was 95 minutes. | |
| ICP | Before mg/L | After mg/L | Before mg/L | After mg/L | Before mg/L | After mg/L |
| Al | <2 | 750 | <2 | 1700 | <2 | 218 |
| B | <2 | 58 | <2 | 110 | <2 | 14.5 |

TABLE 3-continued

| | | | | | | |
|---|---|---|---|---|---|---|
| Ca | <2 | 6.5 | <2 | 12 | <2 | 2.4 |
| Cu | <2 | <2 | <2 | <2 | <2 | <2 |
| Fe | <2 | 3.4 | <2 | 7.5 | <2 | <2 |
| K | <2 | 53 | <2 | 230 | 5.1 | 35.5 |
| Mg | <2 | 4.1 | <2 | 7.4 | <2 | <2 |
| Mo | <2 | <2 | <2 | <2 | <2 | <2 |
| Na | <2 | 160 | 3.6 | 280 | 5670 | 4870 |
| P | <2 | 57 | <2 | 12 | 3.3 | 4.4 |
| Pb | <2 | <2 | <2 | <2 | <2 | <2 |
| Si | <2 | 57 | <2 | 100 | <2 | 15.7 |
| Sr | <2 | <2 | <2 | <2 | <2 | <2 |
| Zn | <2 | 19 | <2 | 35 | <2 | 4.7 |
| Deposit on Tube Surface and cleaning results | 100% of the tube surface covered with deposits | About 80% of the deposits was removed | 100% of the tube surface covered with deposits | All deposits were removed. | 100% of the tube surface covered with deposits | All deposits were removed. |
| pH, as is | 1.6 | 1.6 | 1.5 | 1.5 | 1.8 | 1.7 |
| EG, vol % | 21.1 | 20.1 | 22.9 | 20.1 | 46.7 | 48.5 |

NA—Not available
*Comparative Example

Examples 12-21 show that the cleaning compositions comprising oxalic acid show superior deposit removal compared to other acids (see comparative examples 17 and 18).

Examples 22-28

Deposits from a radiator used in a vehicle wherein the heat transfer system comprised an aluminum component made by CAB (that was not cleaned prior to installation) were exposed to various cleaning solutions. The cleaning solutions were tested by ICP prior to the exposure and after the exposure. Results are in Table 4. The measured temperatures of the cleaning solutions are also shown in Table 4 for the samples where temperature was measured.

TABLE 4

| | Example 22 4.0 g of test solution, i.e., 2 wt % Oxalic acid (from 20% BZT in EG) + 0.0125 wt % Pluronic L-61 + Chromatint Yellow 0963. Solution prepared by mixing 1 part of cleaner formulation "11" in Table 2 with 3 parts of deionized water) to adjust pH to 2.52, was used.. Water bath T = 90 C., 60 min contact time, 0.0561 g deposit added to vial. Some deposit dissolve, a lot of deposit remained after test | | Example 23 4.0 g of test solution, i.e., 2 wt % Oxalic Acid dihydrate + 0.15 wt % benzotriazole (from 20 wt % BZT in EG) + 0.0125 wt % Pluronic L-61 + 11.72 wt % Ethylene glycol. The remainder is DI water, Prepared by mixing 1 part of cleaner formulation "1" with 3 parts of DI water, was used.. Water bath T = 90 C., 60 min contact time, 0.0659 g deposit added to vial. Some deposit dissolve, a lot of deposit remained after test. Top protion of solution submitted for analysis. | | Example 24 4.0 g of test solution containing 2.0 wt % citric acid, 0.1 wt % benzotriazole and 97.9 wt % DI water (pH = 2.16) added to the vial containing 0.0671 g deposit, room Temperature, 2 days contact time. Lots of Deposit largely remained @ end of the test. Top portion solution sent for analysis. | |
|---|---|---|---|---|---|---|
| ICP | Before mg/L | After mg/L | Before mg/L | After mg/L | Before mg/L | After mg/L |
| Al | <2 | 520 | <2 | 690 | <2 | 160 |
| B | <2 | 48 | <2 | 61 | <2 | 54 |
| Ca | 4.6 | <2 | <2 | 3 | <2 | 3.2 |
| Cu | <2 | <2 | <2 | <2 | <2 | <2 |
| Fe | <2 | 5.6 | <2 | 7.8 | <2 | <2 |
| K | <2 | 3.5 | <2 | 3.7 | <2 | 4.5 |
| Mg | <2 | 3.2 | <2 | 3.5 | <2 | <2 |
| Mo | <2 | <2 | <2 | <2 | <2 | <2 |
| Na | 3700 | 3700 | <2 | 150 | <2 | 150 |
| P | <2 | 4.2 | <2 | 5.9 | <2 | 2.5 |
| Pb | <2 | <2 | <2 | <2 | <2 | <2 |
| Si | <2 | 52 | <2 | 63 | <2 | 43 |
| Sr | <2 | <2 | <2 | <2 | <2 | <2 |
| Zn | <2 | 19 | <2 | 25 | <2 | 15 |
| pH | 2.6 | | | | 2.16 | |
| | E-time, min | Temp, C. | E-time, min | Temp, C. | E-time, min | Temp, C. |
| | 0 | 85.3 | 0 | 84.8 | | Room Temp |
| | 10 | 88.9 | 12 | 90.5 | | |
| | 20 | 92.3 | 24 | 91.4 | | |

TABLE 4-continued

| | | | |
|---|---|---|---|
| 30 | 90 | 49 | 94.8 |
| 45 | 90.2 | 60 | 91.1 |

| | Example 25<br>4.0 g of test solution, i.e., 2 wt % Oxalic acid dihydrate + 0.15 wt % BZT (from 20% BZT in EG) + 0.0125 wt % Pluronic L-61 + 0.0125 wt % D11013X Chromatint Yellow 0963 (i.e., 150 g cleaner formulation "11" in table 2 + 450 g DI H2O) was used.. Water bath T = 90 C., 60 min contact time, 0.0562 g deposit added to vial. Some deposit dissolve, a lot of deposit remained after test. Top portion of solution submitted for analysis | | Example 26<br>4.0 g of test solution, i.e., 2 wt % Oxalic acid dihydrate + 0.15 wt % BZT (from 20% BZT in EG) + 0.0125 wt % Pluronic L-61 + 0.0125 wt % D11013X Chromatint Yellow 0963. The solution was prepared by mixing 1 part of cleaner formulation "11" in Table 2 with 3 parts of deionized water) to adjust pH to 3.5, was used.. Water bath T = 90 C., 60 min contact time, 0.0578 g deposit added to vial. Some deposit dissolve, a lot of deposit remained after test. Top portion of solution submitted for analysis | |
|---|---|---|---|---|
| ICP | Before mg/L | After mg/L | Before mg/L | After mg/L |
| Al | <2 | 660 | <2 | 550 |
| B | <2 | 56 | <2 | 50 |
| Ca | <2 | 4.5 | <2 | 2 |
| Cu | <2 | <2 | <2 | <2 |
| Fe | <2 | 7.5 | <2 | 5.7 |
| K | <2 | 3.2 | <2 | 5.2 |
| Mg | <2 | 3.8 | <2 | 3.2 |
| Mo | <2 | <2 | <2 | <2 |
| Na | <2 | 140 | 4400 | 4800 |
| P | <2 | 4.7 | <2 | 4.4 |
| Pb | <2 | <2 | <2 | <2 |
| Si | <2 | 63 | <2 | 63 |
| Sr | <2 | <2 | <2 | <2 |
| Zn | <2 | 24 | <2 | 20 |
| pH | | | | |
| | E-time, min | Temp, C. | E-time, min | Temp, C. |
| | 0 | 85.6 | 0 | 87.1 |
| | 6 | 88.4 | 32 | 89.8 |
| | 50 | 90 | 42 | 93 |
| | 60 | 93.6 | 60 | 92.7 |

| | Example 27<br>4.0 g of a test solution containing 2.0 wt % citric acid and 98 wt % DI water => NB2432-134-13, added to the vial containing 0.0556 g deposit, 90 C., 60 min contact time, Lots of Deposit largely remained @ end of the test. Top portion solution sent for analysis. | | Example 28<br>4.0 g of test solution, i.e., 2 wt % Oxalic Acid dihydrate + 0.15 wt % benzotriazole (from 20 wt % BZT in EG) + 0.0125 wt % Pluronic L-61 + 22.84 wt % Ethylene glycol. The remainder is DI water, Prepared by mixing 1 part of cleaner formulation "10" in Table 1 with 3 parts of DI water, was used.. Water bath T = 90 C., 60 min contact time, 0.0560 g deposit added to vial. Some deposit dissolve, a lot of deposit remained after test. Top protion of solution submitted for analysis. | |
|---|---|---|---|---|
| ICP | Before mg/L | After mg/L | Before mg/L | After mg/L |
| Al | <2 | 410 | <2 | 530 |
| B | 2.1 | 64 | <2 | 50 |
| Ca | <2 | 4.2 | <2 | 4.7 |
| Cu | <2 | <2 | <2 | <2 |
| Fe | <2 | 4.1 | <2 | 6.5 |
| K | <2 | 4.4 | <2 | 3.6 |
| Mg | <2 | 3.5 | <2 | 3.8 |
| Mo | <2 | <2 | <2 | <2 |
| Na | <2 | 140 | 4.4 | 130 |
| P | <2 | 3.9 | <2 | 5.6 |
| Pb | <2 | <2 | <2 | <2 |
| Si | <2 | 65 | <2 | 53 |
| Sr | <2 | <2 | <2 | <2 |
| Zn | <2 | 25 | <2 | 21 |
| pH | 2.18 | | | |
| | E-time, min | Temp, C. | E-time, min | Temp, C. |
| | 0 | 86 | 0 | 85.6 |
| | 20 | 89.4 | 2 | 90 |

TABLE 4-continued

| | | | | |
|---|---|---|---|---|
| | 46 | 89.7 | 12 | 86.5 |
| | 55 | 93.5 | 60 | 92 |
| | 60 | 92.6 | | |

*Comparative example

The data presented above supports the following conclusions. 1. Oxalic acid based cleaners are more effective than the citric acid and 2-phosphonobutane-1,2,4-tricarboxylic acid based cleaners. 2. Adding high concentration of ethylene glycol will not degrade the cleaning performance of the oxalic acid based cleaner in cleaning the deposits in engine cooling systems. 3. Oxalic acid cleaner can still clean deposit effectively when the cleaning solution to pH between 3.5 and 6.4. Increasing cleaning solution pH will reduce corrosivity of the cleaning solution, leading to reduction of hydrogen gas evolution during the cleaning process. 4. The cleaner with a dye that is resistant to reduction reaction associated with hydrogen evolution on aluminum and steel surface would allow the cleaner to be formulated with color cleaner that is more user friendly (see Table 2).

Examples A-D

A post cleaning condition was simulated to examine the relationship between the cleaning composition and the conditioning composition. The post cleaning condition simulated the situation in which the cleaning composition is not completely flushed from the system and residual cleaning composition mixes with the conditioning composition. The conditioning composition is shown in Table 5. Results are shown in Table 5.

TABLE 5

| Ingredients | CAS No. | A* | B* | C | D |
|---|---|---|---|---|---|
| Deionized Water | 7732-18-5 | 100 | 93.4500 | 87.8350 | 84.9100 |
| Sodium Carbonate, solid | 497-19-8 | | 6.0000 | | |
| Sodium Tolytriazole, 50% | 64665-57-2 | | 0.5000 | 0.5000 | 0.2500 |
| Pluronic L-61 | 9003-11-6 | | 0.0500 | 0.0500 | 0.0500 |
| Aquatreat AR-940 polymer, Sodium polyacrylate, MW = 2600. | Proprietary | | | 0.1000 | 0.1000 |
| Magnesium nitrate, hexahydrate | 13446-18-9 | | | 0.0150 | |
| Phosphoric acid, 75% | 7664-38-2 | | | 5.0000 | 0.7500 |
| Sodium hydroxide, 50% | 1310-73-2 | | | 6.5000 | 0.9400 |
| Dipotassium sebacate | 52457-55-3 | | | | 13.0000 |
| Sodium Benzoate | 532-32-1 | | | | |
| Total | | 100.0000 | 100.0000 | 100.0000 | 100.0000 |
| pH of the solution | | About 7 | 11.7 | 10.6 | 10.3 |
| Simulated post cleaning test with the use of a conditioner formulation. Test conditions approximate a set of typical use conditions. | | 2.6 g of Cleaner formulation "11" in Table 2 was added into 97.4 g Danbury Tap water. Place a cleaned and polished SAE329 cast aluminum coupon. Heated to 65 ± 3 C. Maintain temperature for 30 min with aluminum coupon in the solution. | 2.6 g of Cleaner formulation "11" in Table 2 was added into 88.3 g Danbury Tap water and 9.1 g conditioner "B". Place a cleaned and polished SAE329 cast aluminum coupon. Heated to 65 ± 3 C. Maintain temperature for 30 min with aluminum coupon in the solution. | 2.6 g of Cleaner formulation "11" in Table 2 was added into 88.3 g Danbury Tap water and 9.1 g conditioner "C". Place an SAE329 cast aluminum coupon. Heated to 65 ± 3 C. Maintain temperature for 30 min with aluminum coupon in the solution. | 2.6 g of Cleaner formulation "11" in Table 2 was added into 88.3 g Danbury Tap water and 9.1 g conditioner "D". Place an SAE329 cast aluminum coupon. Heated to 65 ± 3 C. Maintain temperature for 30 min with aluminum coupon in the solution. |
| Observation during and after test | | The aluminum coupon corroded uniformly. Large amount of hydrogen gas evolved when the coupon was in the solution. | Localized corrosion on the aluminum coupon occurred and coupon was slightly darkened and pitted afer test. Large amount of hydrogen gas evolved when the coupon was in the solution. | No visible corrosion was observed on the coupon after test. Coupon was shiny and appeared to be the same as before immersion. | No visible corrosion was observed on the coupon after test. Coupon was shiny and appeared to be the same as before immersion. |
| pH of the post test solution | | 2.2 | 9.7 | 6.4 | 5.7 |

*Comparative Example

Examples 29-32

Additional cleaner compositions were made and tested for storage stability, as summarized in Table 6.

TABLE 6

| | Example 29 | Example 30 | Example 31* | Example 32* |
|---|---|---|---|---|
| Oxalic acid dihydrate, Technical grade | 17.1998 | 26.4012 | 9.0000 | 9.0000 |
| 20% Benzotriazole in Ethylene Glycol | 2.7008 | 2.4007 | 4.5000 | 3.9375 |
| Pluronic L-61 antifoam/surfactant | 0.0453 | 0.0404 | 0.0560 | 0.0560 |
| Ethylene Glycol | 72.0489 | 71.1577 | 0.0000 | 0.0000 |
| Deionized Water | 8.0052 | 0.0000 | 86.4440 | 87.0065 |
| Total | 100.0000 | 100.0000 | 100.0000 | 100.0000 |
| Total Ethylene Glycol, wt % | 74.2095 | 73.0782 | 3.6000 | 3.1500 |
| Observation - After Stored for ~65 hours @ 55° F. | At room temperature, solution uniform and clear; No solid phase, particulates or precipitate observed. | At room temperature, e.g., solution uniform and clear; No solid phase, particulates or precipitate observed. | Significant amount of precipitate observed at room temperature. Not all ingredients were soluble. | Significant amount of precipitate observed at room temperature. Not all ingredients were soluble. |
| Observation - After Stored for 24 hours @ 10° F. | Solution Uniform and clear; No solid phase, particulates or precipitate observed | Solution Uniform and clear; No solid phase, particulates or precipitate observed | NA | NA |
| Observation - After allowing the samples to thaw and return to room temperature @ ~70° F. | No Change | No Change | NA | NA |

Examples 29-32 show that increasing amounts of ethylene glycol results not only better storage stability of the cleaner concentrates, but also enables higher concentrations of oxalic acid due to better solubility.

All ranges disclosed herein are inclusive and combinable. While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A heat transfer system conditioner for use in a heat transfer system that has been pre-treated with a cleaning solution, the heat transfer system conditioner comprising:

a) water;

b) a water soluble alkaline metal phosphate;

c) one or more azole compounds; and d) optionally, a corrosion inhibitor, scale inhibitor, acid neutralizer, colorant, surfactant, antifoam, stop-leak agent, or combinations thereof;

the cleaning solution comprising:

a) greater than 15 weight percent of a freezing point depressant based on total weight of the cleaning solution;

b) oxalic acid in an amount ranging from about 8 to about 35 weight percent or from about 5 to about 10 weight percent based on total weight of the cleaning solution; and c) an azole compound;

wherein the cleaning solution is a uniform solution; and wherein the solution is stable at about 10° F. to about 55° F.

2. The conditioner of claim 1, wherein the water soluble alkaline metal phosphate is sodium phosphate or potassium phosphate.

3. The conditioner of claim 1, wherein the water soluble alkaline metal phosphate is 0.2 to 15 wt % based on total weight of the conditioner.

4. The conditioner of claim 1, wherein the one or more azole compounds are 0.05 to 5 wt % based on total weight of the conditioner.

5. The conditioner of claim 1, wherein the stop-leak agent is attaclay or soybean meal.

6. The conditioner of claim 1, wherein the pH is greater than or equal to 7.5 at 15° to 25° C.

7. The conditioner of claim 1, wherein the pH is 8.5 to 11 at 15° to 25° C.

8. A heat transfer system conditioner for use in a heat transfer system that has been pre-treated with a cleaning solution, the heat transfer system conditioner comprising:

a) water;

b) one or more azole compounds;

c) an antifoam/surfactant;

d) a water soluble polymer; and e) phosphoric acid; and the cleaning solution comprising:

a) greater than 15 weight percent of a freezing point depressant based on total weight of the cleaning solution;

b) oxalic acid in an amount ranging from about 8 to about 35 weight percent or from about 5 to about 10 weight percent based on total weight of the cleaning solution;

c) an azole compound;

wherein the cleaning solution is a uniform solution; and wherein the solution is stable at about 10° F. to about 55° F.

9. The conditioner of claim 8 further comprising sodium hydroxide.

10. The conditioner of claim 8 further comprising a corrosion inhibitor.

11. The conditioner of claim 10, wherein the corrosion inhibitor is selected from the group consisting of an alkaline metal benzoate, alkaline metal molybdate, alkaline metal nitrite, and combinations thereof.

12. A heat transfer system conditioner for use in a heat transfer system that has been pre-treated with a cleaning solution, the heat transfer system conditioner comprising:

a) water;

b) one or more azole compounds;

c) an antifoam/surfactant;

d) a water soluble polymer;

e) phosphoric acid; and f) a corrosion inhibitor selected from the group consisting of sodium benzoate, an alkaline metal molybdate, an alkaline metal nitrite, and combinations thereof; and the cleaning solution comprising greater than 15 weight percent of a freezing point depressant based on total weight of the cleaning solution.

13. The conditioner of claim 10, wherein the corrosion inhibitor is magnesium nitrate.

14. The condition of claim 8, wherein the one or more azole compounds is sodium tolytriazole.

15. The conditioner of claim 8, wherein the antifoam/surfactant is nonionic.

16. The conditioner of claim 15, wherein the nonionic antifoam/surfactant is a nonionic triblock copolymer.

17. The conditioner of claim 8, wherein the water soluble polymer is a polyacrylate.

18. The conditioner of claim 17, wherein the polyacrylate is sodium polyacrylate.

19. A heat transfer system conditioner for use in a heat transfer system that has been pre-treated with a cleaning solution, the heat transfer system conditioner comprising:

a) water;

b) one or more azole compounds;

c) an antifoam/surfactant;

d) a water soluble polymer;

e) phosphoric acid; and f) dipotassium sebacate; and the cleaning solution comprising greater than 15 weight percent of a freezing point depressant based on total weight of the cleaning solution.

20. The conditioner of claim 8, wherein the condition comprises:

a) 0.25 to 0.5 wt % of one or more azole compounds based on total weight of the conditioner;

b) 0.5 wt % of a nonionic triblock copolymer based on total weight of the conditioner;

c) 0.1 wt % of a polyacrylate based on total weight of the conditioner;

d) 0.75 to 5 wt % phosphoric acid based on total weight of the conditioner; and e) 0.94 to 6.5 wt % sodium hydroxide based on total weight of the conditioner.

21. The conditioner of claim 20 further comprising 0.015 wt % magnesium nitrate based on total weight of the conditioner.

22. The conditioner of claim 20 further comprising 13 wt % sodium sebacate based on total weight of the conditioner.

23. A method of cleaning a heat transfer system comprising:

a) circulating a cleaning solution in the heat transfer system;

b) circulating the conditioner of claim 1 in the heat transfer system; and c) flushing the heat transfer system.

24. The method of claim 23, wherein the conditioner is circulated at a temperature less than the boiling temperature of the conditioner.

25. The method of claim 24, wherein the temperature is between ambient and 80° C.

26. The method of claim 23 further comprising adding a heat transfer fluid after the conditioner is flushed from the heat transfer system.

27. The method of claim 23, wherein the cleaning solution comprises about 8 to 35 wt % of oxalic acid.

* * * * *